US007404788B2

(12) United States Patent
Monti

(10) Patent No.: US 7,404,788 B2
(45) Date of Patent: Jul. 29, 2008

(54) METHOD AND AN APPARATUS FOR PICKING UP FLAT FOLDED TUBULAR BLANKS FROM A MAGAZINE AND FOR MOVING THEM TO AN ERECTING STATION

(75) Inventor: Giuseppe Monti, Pianoro (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 0 days.

(21) Appl. No.: 11/676,533

(22) Filed: Feb. 20, 2007

(65) Prior Publication Data

US 2007/0197364 A1 Aug. 23, 2007

(30) Foreign Application Priority Data

Feb. 20, 2006 (IT) ..... BO2006A0123

(51) Int. Cl.
*B31B 1/80* (2006.01)

(52) U.S. Cl. ..... 493/316; 493/309; 493/318

(58) Field of Classification Search ..... 493/316, 493/309, 310, 317, 318
See application file for complete search history.

(56) References Cited

U.S. PATENT DOCUMENTS 3,242,827 A * 3/1966 Winters ..... 493/315
3,613,525 A * 10/1971 Lense et al. ..... 493/315
4,109,444 A * 8/1978 Lee ..... 53/566
4,871,348 A * 10/1989 Konaka ..... 493/315
5,102,385 A * 4/1992 Calvert ..... 493/315
5,207,630 A * 5/1993 Decker et al. ..... 493/313
5,411,464 A * 5/1995 Calvert et al. ..... 493/315
5,415,615 A * 5/1995 Culpepper ..... 493/315
5,473,868 A * 12/1995 Antonio ..... 53/566
5,715,657 A * 2/1998 Mondani et al. ..... 53/457
6,913,568 B2 * 7/2005 Frank et al. ..... 493/309

FOREIGN PATENT DOCUMENTS

EP 1584455 A1 * 10/2005

* cited by examiner

*Primary Examiner*—Sameh H. Tawfik
(74) *Attorney, Agent, or Firm*—William J. Sapone; Coleman Sudol Sapone P.C.

(57) ABSTRACT

In an apparatus for picking up flat folded tubular blanks from a magazine and for moving the blanks to an erecting station, a horizontal transmission shaft transmits a rotational movement about a first articulation axis to a functional arm hinged with one side to a terminal portion of the transmission shaft. Another side of the functional arm is hinged to an arrangement control mechanism for controlling arrangement of the functional arm about a second articulation axis. The functional arm is also operated into rotation about the first articulation axis between a position in alignment with the functional arm, and a square position arranged at 90 degrees with respect to the functional arm, and vice versa. A pick up arm is connected to arrangement control mechanism and carries suction cups for picking up a flat folded tubular blank through the open bottom of the magazine. The arrangement control mechanism is moved with respect to the second articulation axis for operating the apparatus, beside the operation of the functional arm affected by the transmission shaft, between a picking up station and an erection station for erecting the tubular blank, and vice-versa.

10 Claims, 7 Drawing Sheets

FIG. 3
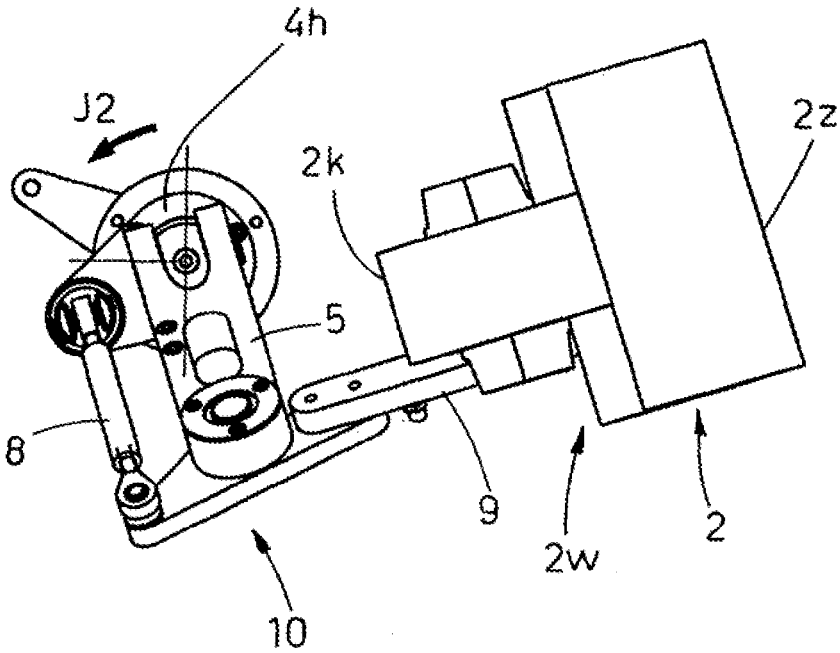
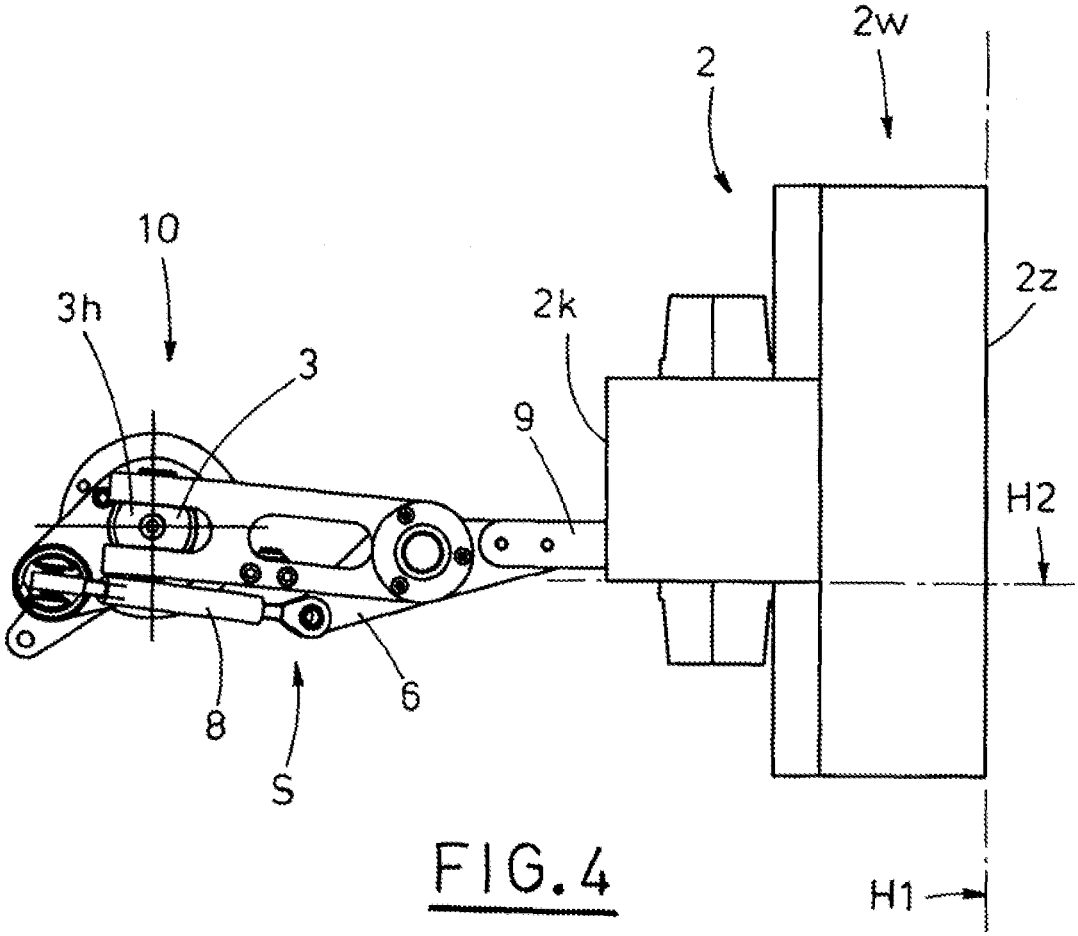
FIG. 4

FIG. 3A
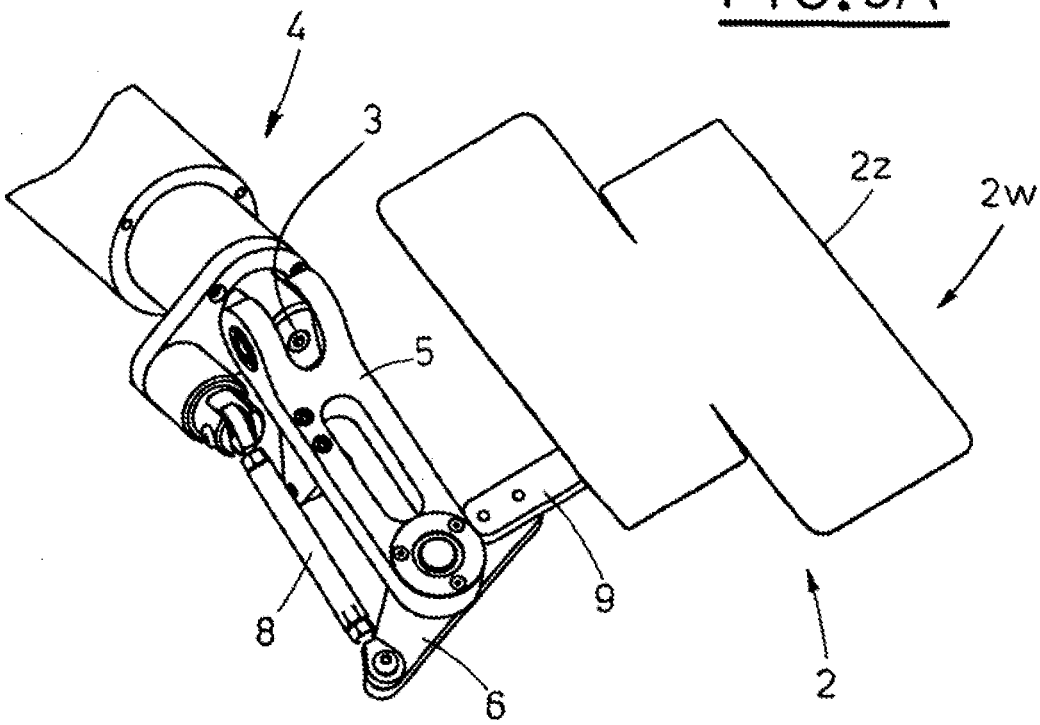
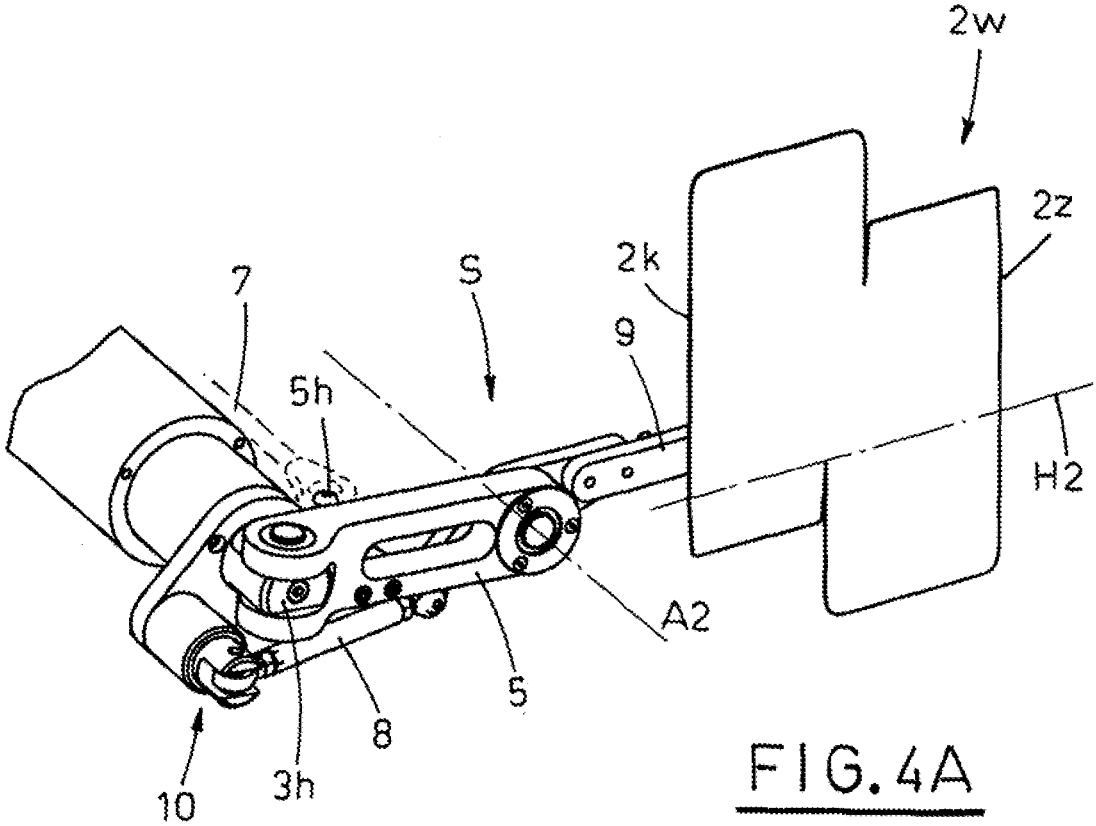
FIG. 4A

FIG.4B
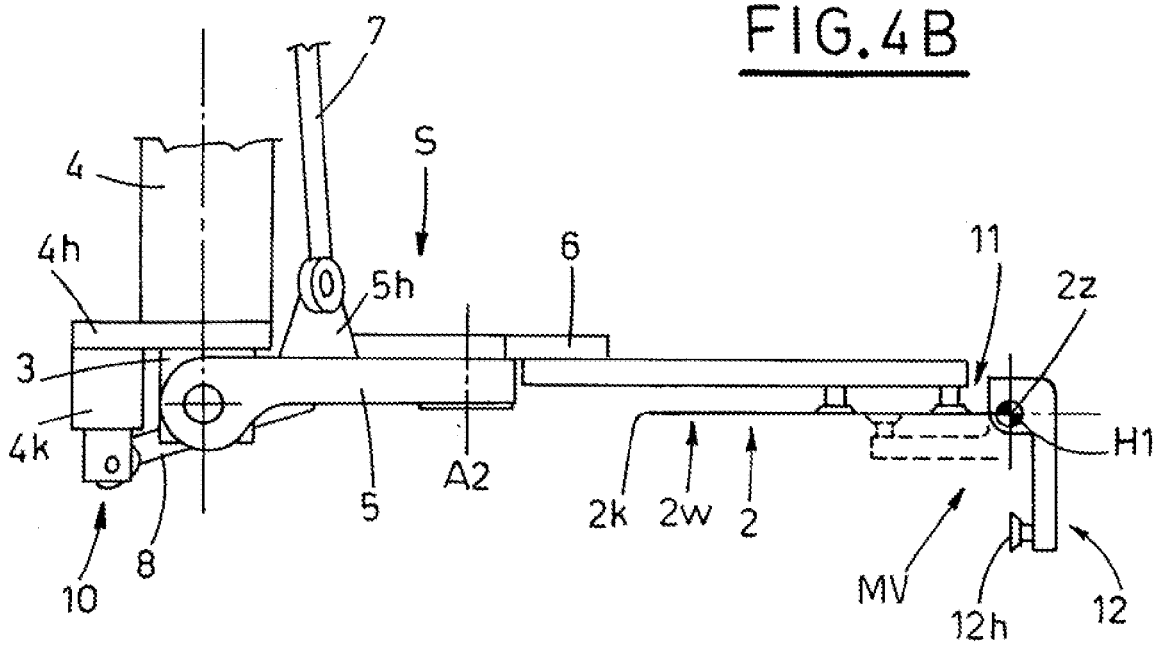
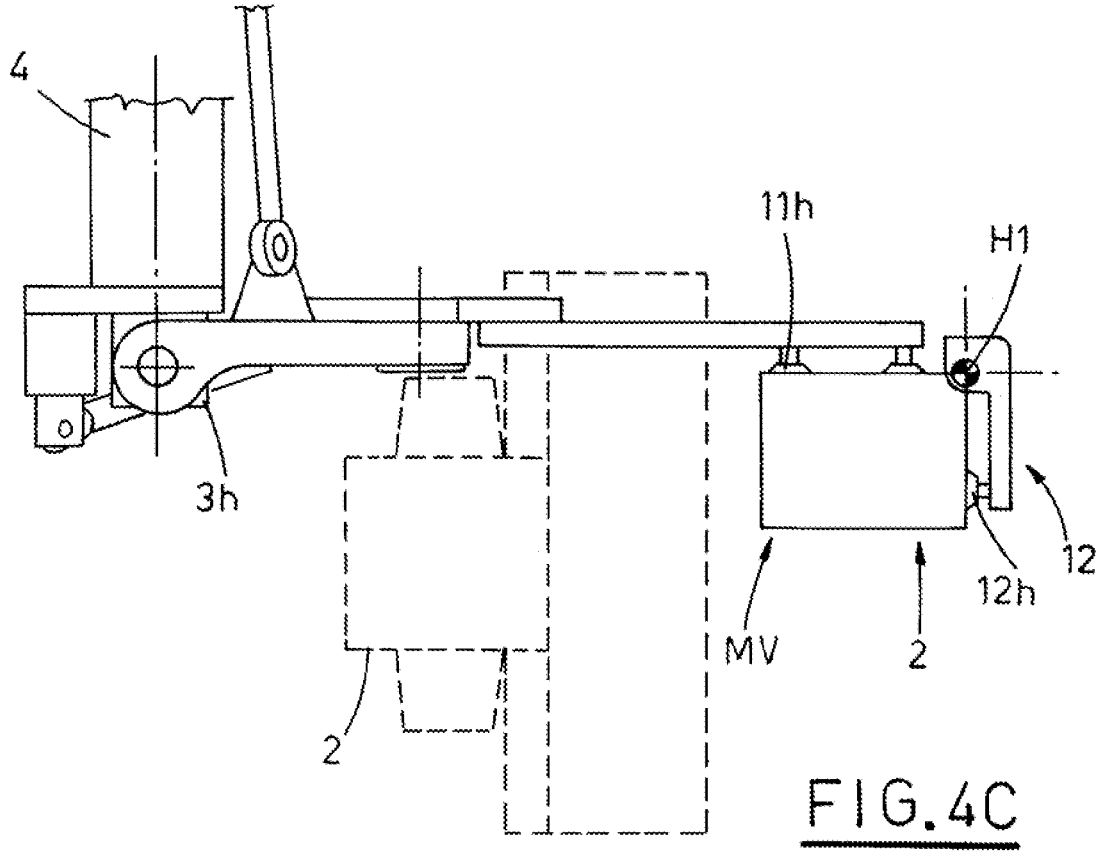
FIG.4C

FIG. 5A
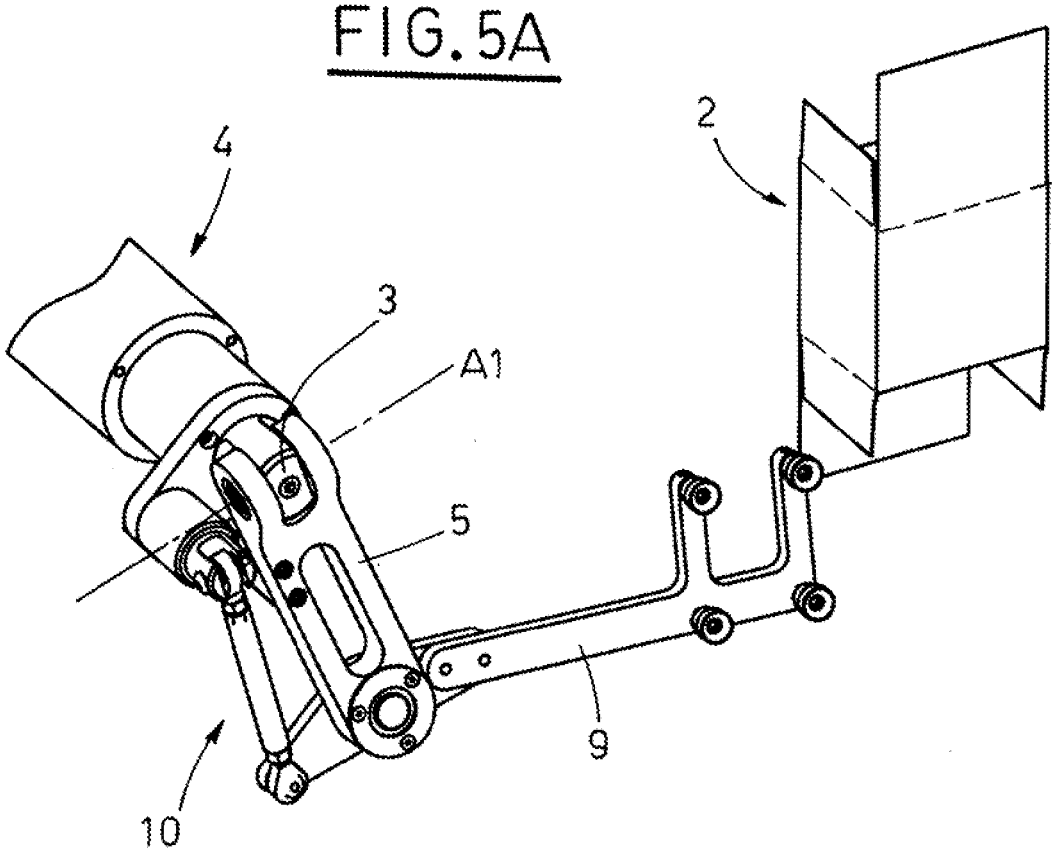
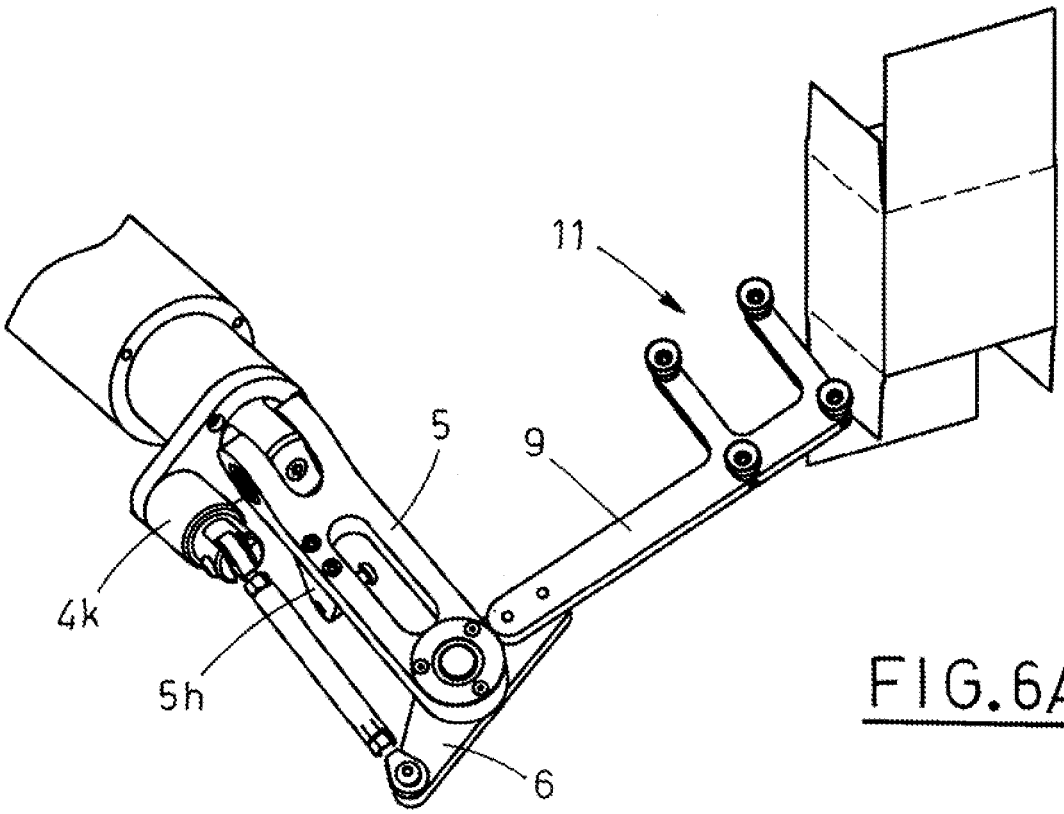
FIG. 6A

METHOD AND AN APPARATUS FOR PICKING UP FLAT FOLDED TUBULAR BLANKS FROM A MAGAZINE AND FOR MOVING THEM TO AN ERECTING STATION

BACKGROUND OF THE INVENTION

The present invention relates to boxing machines, aimed particularly at picking up flat folded tubular blanks from a magazine, at erecting them with the axis oriented vertically and at filling them along the same direction, with articles of various kinds, such as bottles.

Especially, the invention relates to an apparatus, being an integral part of a boxing machine, and a related method for picking up flat folded tubular blanks from an open and inclined bottom of a magazine and for their transfer to an erecting station.

DESCRIPTION OF THE PRIOR ART

The expression flat folded "tubular blank" indicates an object made of cardboard or Bristol board, in which two opposite sheets touch each other and are connected at two opposite ends, so as to define just a flat configuration.

The blank has also longitudinal creasing lines, which facilitate blank folding in order to make it assume a substantially parallelepiped shape, and transversal creasing lines, which facilitate folding of the flaps in order to close the blank bottom and cover.

The boxes are usually made of light cardboard and the tubular blanks for making them have each one three flaps at each end, two of which are opposite and have the same shape, while the remainder has larger dimension and is defined by a tab for closing the corresponding end.

For this reason, that is because of the particular extension of the closing tab, the boxes are preferably loaded inside magazines having outlet sections inclined or vertical, so that only one of the ends connecting the two sheets defining the case or box acts as a support element.

What above is aimed at preventing the part of the weight of the generic blank, and that of the ones above it, acting parallel to its extension and uniformly along the related lower edge from reaching values that could cause anomalous and undesired folding of the blank portions.

However, those skilled in the field know technical solutions, according to which the blanks are loaded to the magazine in a vertical arrangement, with the corresponding flaps lying on the magazine bottom, as described in the EP 1.584.455 concerning a method and device for conveying and erecting boxes.

A similar arrangement of flat folded tubular blanks inside the magazine can cause a premature, undesired and uncontrolled folding of the flaps of one or more blanks, thus provoking its incorrect withdrawing from the outlet section of the magazine and consequently its rejection, or else machine downtimes, with all the negative consequences that can result therefrom.

The document EP 447.375 describes a device associated to a line including at least two identical chains, winding endlessly and laying on horizontal planes, moved with the same speed and having radial prongs, which are oriented outwards and thus defining a series of vertical seats; and a magazine containing a pile of blanks in flat folded configuration.

First means pick up a blank from the pile and place it horizontally in an intermediate station, where second means, acting in time relation with the first ones, grip the blank, which is moved, so that its axis passes progressively from the horizontal orientation to the vertical one.

Meanwhile, the blank is also made to rotate with respect to its axis, so that it strikes first a stationary abutment, which partially erects the blank, and subsequently the prongs of a corresponding vertical seat, with a velocity component contrary to the prongs translation direction, so that the prongs complete the blank erecting.

SUMMARY OF THE INVENTION

The primary object of the present invention is to propose an apparatus and a method, which describes its annexed work steps, aimed at being a part of a vertical acting boxing machine, as well as at picking up flat folded tubular blanks from the open inclined bottom of a magazine and at their transfer to an erecting station with the axis oriented vertically.

The above mentioned object is to be obtained by a sequence of essential work steps, which can be carried out by the above mentioned apparatus without any interference with the regular operation of the whole boxing machine.

Another object of the present invention is to propose a method, which can lead to high production rate at relatively low costs with respect to prior art.

A further object of the invention is to propose a newly conceived apparatus for picking up flat folded tubular blanks from the open, inclined bottom of a magazine and for moving them to an erecting station, said apparatus having essential structure and being reliable, highly productive and relatively cheap with respect to the results to be obtained.

A still further object of the invention is to propose an apparatus, and a related method, which is capable of moving said blanks to an erecting station, situated at a certain distance from the longitudinal extension plane of the magazine.

The above mentioned objects are obtained, in accordance with the contents of the claims, by an apparatus for picking up flat folded tubular blanks from a magazine and for moving the blanks to an erecting station, each blank of said tubular blanks being formed by two opposite sheets, connected to each other at two opposite ends, so as to define a flat folded configuration, said blank having longitudinal creasing lines for facilitating folding, so that a box to be obtained will assumes a substantially parallelepiped shape with a longitudinal axis passing through two opposed openings of a thus obtained box, and transversal creasing lines for facilitating folding of relevant flaps of said blank, and with said magazine having an open bottom for picking up the above mentioned flat folded tubular blanks one by one, with one end of the two connecting ends of said blank turned downwards, the apparatus including:

a horizontal shaft for transmission of a rotation movement, the shaft having a rotation axis parallel to opposite, lower and upper edges of said open bottom of said magazine, said shaft being operated by first actuating means and situated beside said open bottom of said magazine;

a functional arm hinged at one side to a projection of said transmission shaft about a first articulation axis, perpendicular to the shaft, so as to receive a motion transmitted by said shaft;

second actuating means for rotating said functional arm about said first articulation axis, in time relation with activation of said first actuating means, between an alignment position, with said functional arm in alignment with said transmission shaft, and a square position, with said functional arm forming a 90 degrees angle with respect to the rotation axis of said transmission shaft, and vice versa;

an arrangement control mechanism hinged to a free side of said functional arm about a second articulation axis orthogonal to said first articulation axis;

a pick up arm, fastened to said arrangement control mechanism and carrying pick up means for picking up a flat folded tubular blank through the open bottom of said magazine;

moving means, cooperating to move said arrangement control mechanism about the second articulation axis in suitable time relation with activation of said first and second actuation means, to operate, together with the latter, said apparatus between a pick up station for picking up a flat folded tubular blank through the open bottom of said magazine, with said functional arm located in the alignment position and said pick up arm arranged with an arm longitudinal axis parallel to the open bottom of said magazine, and a tubular blank erecting station, with said functional arm located in the square position and the tubular blank arranged with said longitudinal axis vertical, and vice-versa.

The above mentioned apparatus operates according to a method for picking the flat folded tubular blanks from a magazine and for moving the blanks to an erecting station, with said magazine having an open bottom for removing the above mentioned flat folded tubular blanks one by one, with one end of the two connecting ends turned downwards, the method including in a process cycle:

picking up a flat folded tubular blank through the open bottom of said magazine, by gripping a first lateral wall of the blank, turned outward with respect to the magazine, and by downward rotation of the blank to make the blank assume a horizontal arrangement;

moving the gripped blank to an erecting station, with a combined motion of translation and rotation by 90 degrees with respect to an axis parallel to the transversal creasing lines of the blank, so that the blank assumes, in said erecting station, a vertical arrangement, with said longitudinal axis oriented vertically.

BRIEF DESCRIPTION OF THE DRAWINGS

The characteristic features of the invention are pointed out in the following description of some preferred but not exclusive embodiments, with reference to the enclosed figures, in which:

FIG. 3 is a schematic front view of the apparatus proposed by the invention, illustrating the next successive work step which is part of the work cycle, FIG. 3A being a perspective view thereof;

FIG. 4 is a schematic front view of the apparatus proposed by the invention, illustrating the next successive work step which is part of the work cycle, FIG. 4A being a perspective view thereof, FIG. 4B being a top view of the apparatus in the working configuration of FIG. 4, and FIG. 4C being a top view of the apparatus of FIG. 4B, with a flat folded blank of FIG. 4 shown in phantom, and with the blank squared;

DISCLOSURE OF THE PREFERRED EMBODIMENT

Figure 1:
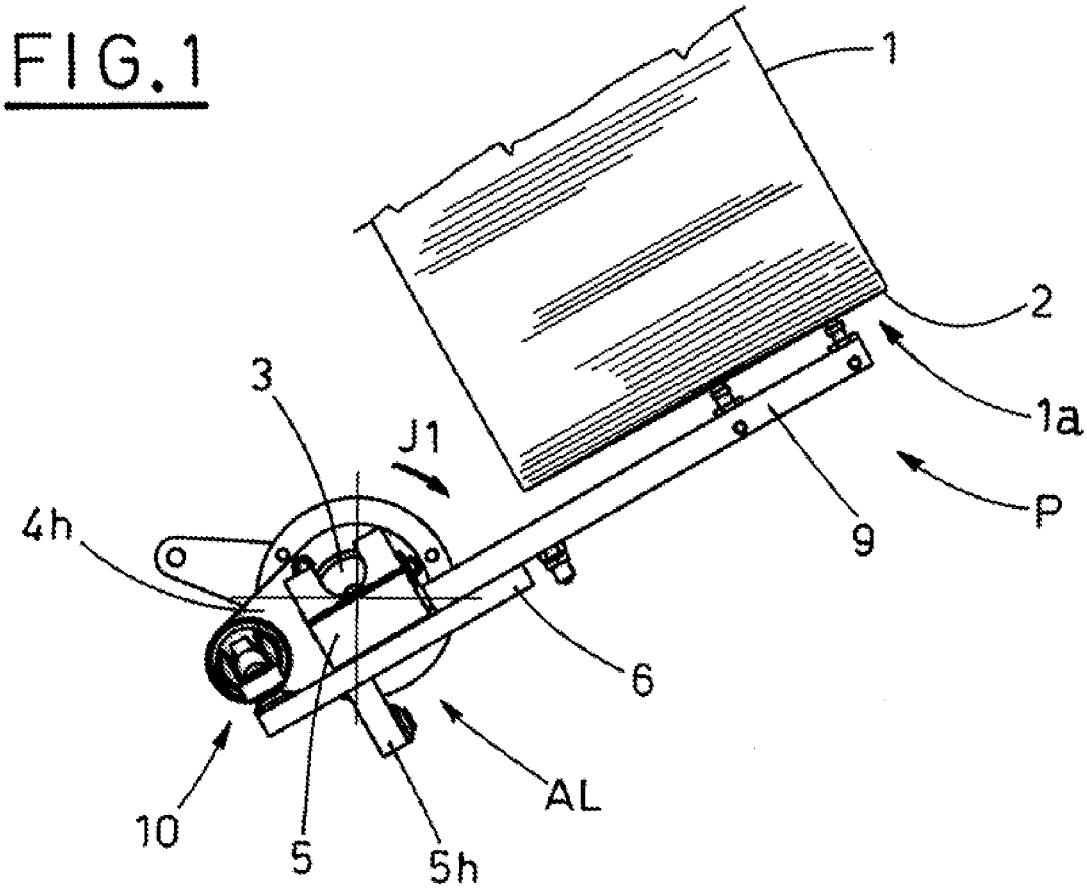
FIG. 1 is a schematic front view of the apparatus proposed by the invention, illustrating a first work step which is part of a work cycle, FIG. 1 A being a perspective view thereof.

Having regard to the enclosed Figures, the reference numeral 1 indicates a magazine of known type, e.g. having a bottom 1*a* open and inclined, only the terminal, inclined part of which is shown schematically (FIGS. 1, 2), and inside which a plurality of tubular blanks 2 in flat folded configuration are piled up.

In each tubular blank 2 two facing sheets can be defined, which are connected to each other along two opposite ends 2*k*, 2*z*, so as to define flat folded configuration 2*w*.

Each blank 2 has longitudinal creasing lines aimed at facilitating its folding, so as to assume parallelepiped shape, and transversal creasing lines aimed at facilitating folding of related flaps.

In the case in point, the tubular blanks 2 form corresponding boxes of light cardboard, having a selected flexibility, therefore only one of the above mentioned connection ends 2*k*, 2*z*, turned downwards, is loaded into the magazine 1, for the reasons already discussed in the introductory note.

The reference numeral 10 indicates generically the apparatus proposed by the invention, aimed at working between a station P for picking up a flat folded tubular blank 2 from the open, inclined bottom 1*a* of the magazine 1, shown in FIGS. 1, 2, and an erecting station MV, where the same blank 2 arrives in vertical position, due to a combined rotation-translation movement, as it will appear in the following.

The apparatus 10 includes a plurality of functional elements, which will be described later.

A horizontal shaft 3 for transmission of the rotation movement has the axis parallel to the opposite, lower and upper edges of the open, inclined bottom of the magazine 1.

Figure 2:
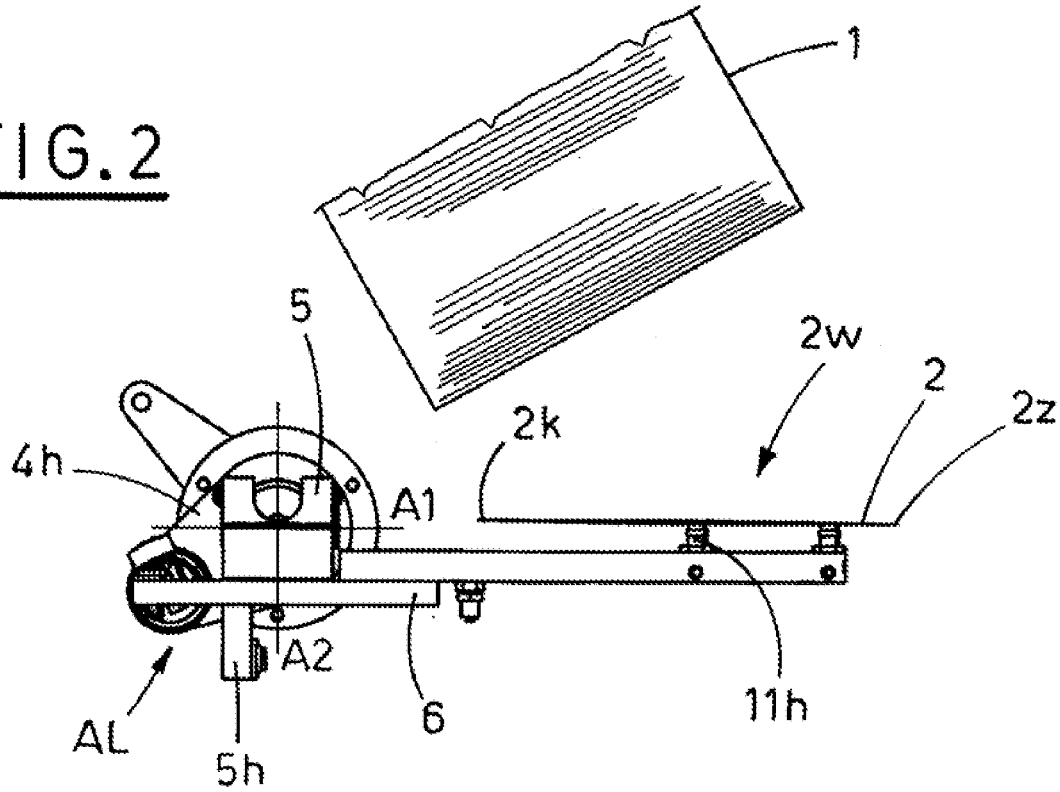
FIG. 2 is a schematic front view of the apparatus proposed by the invention, illustrating the next successive work step which is part of the work cycle, FIG. 2A being a perspective view thereof.
Figure 1A:
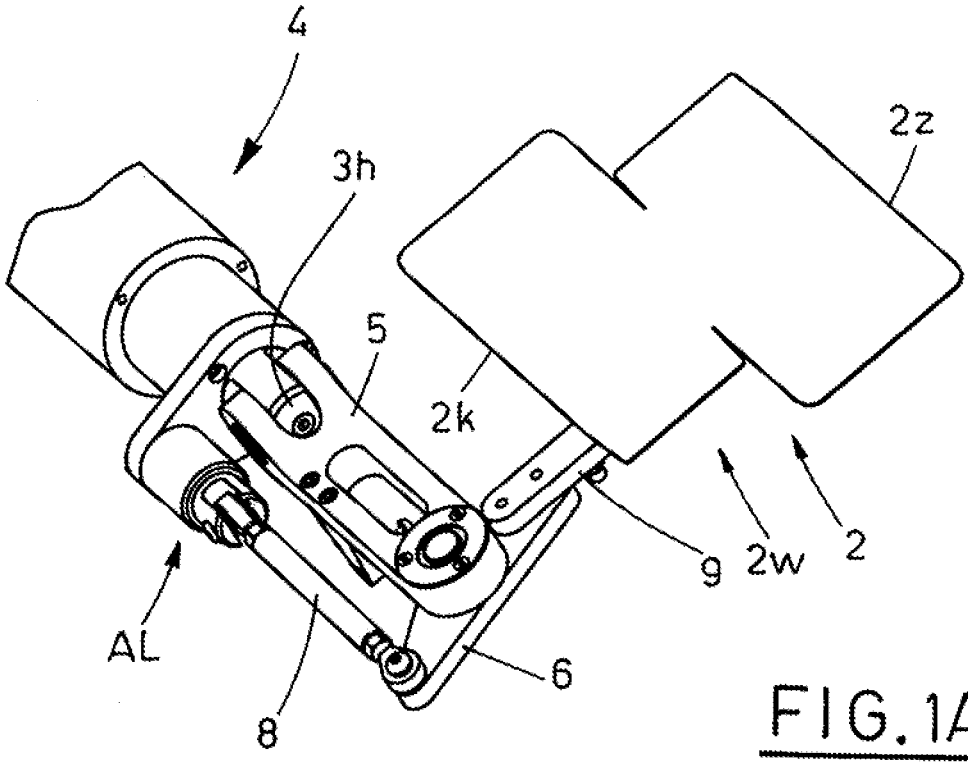
Figure 2A:
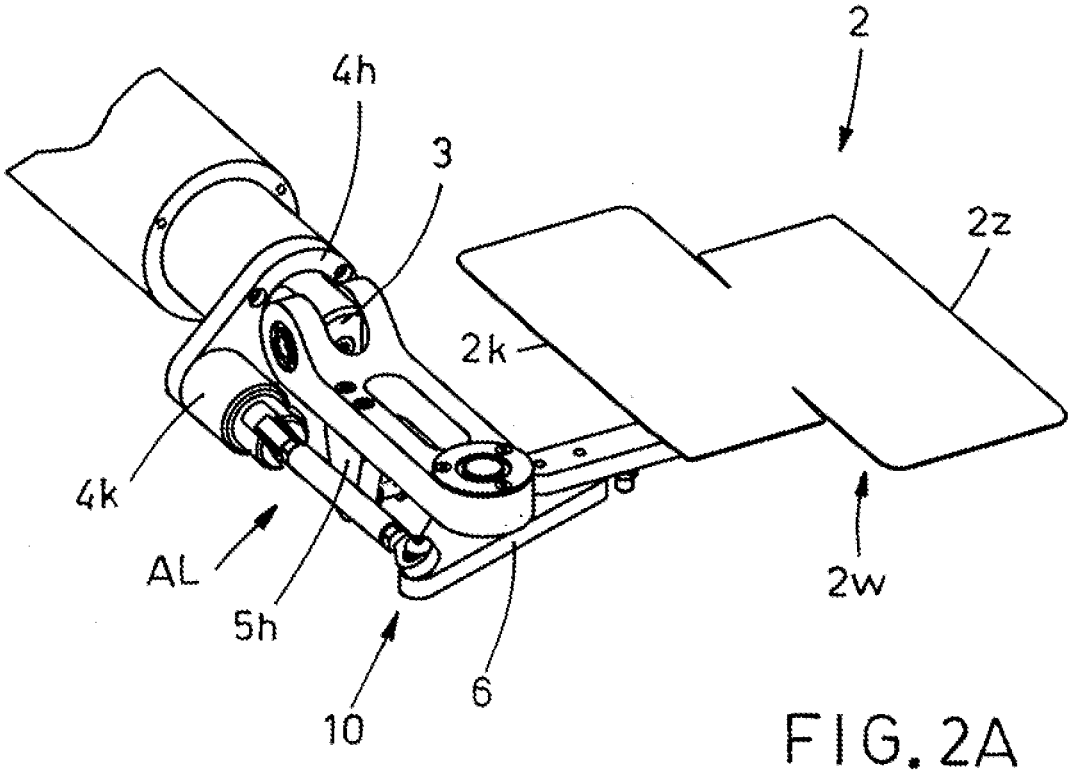
Figure 5:
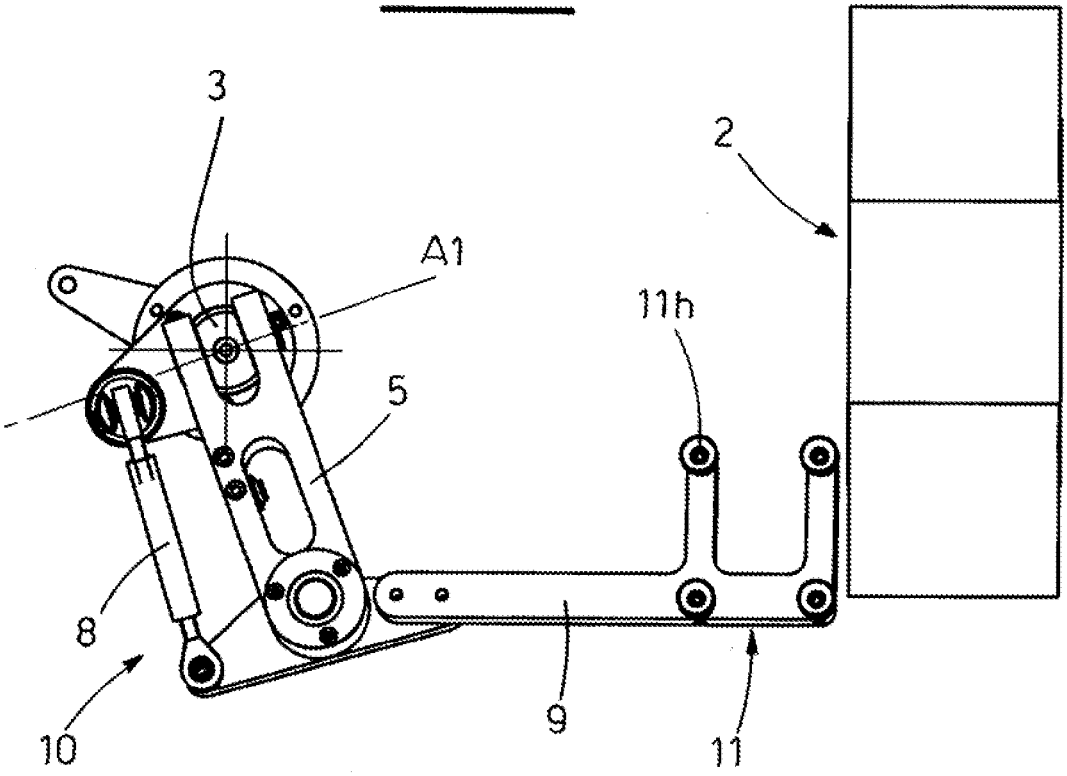
FIG. 5 is a schematic front view of the apparatus proposed by the invention, illustrating the next successive work step which is part of the work cycle, FIG. 5A being a perspective view thereof.
Figure 6:
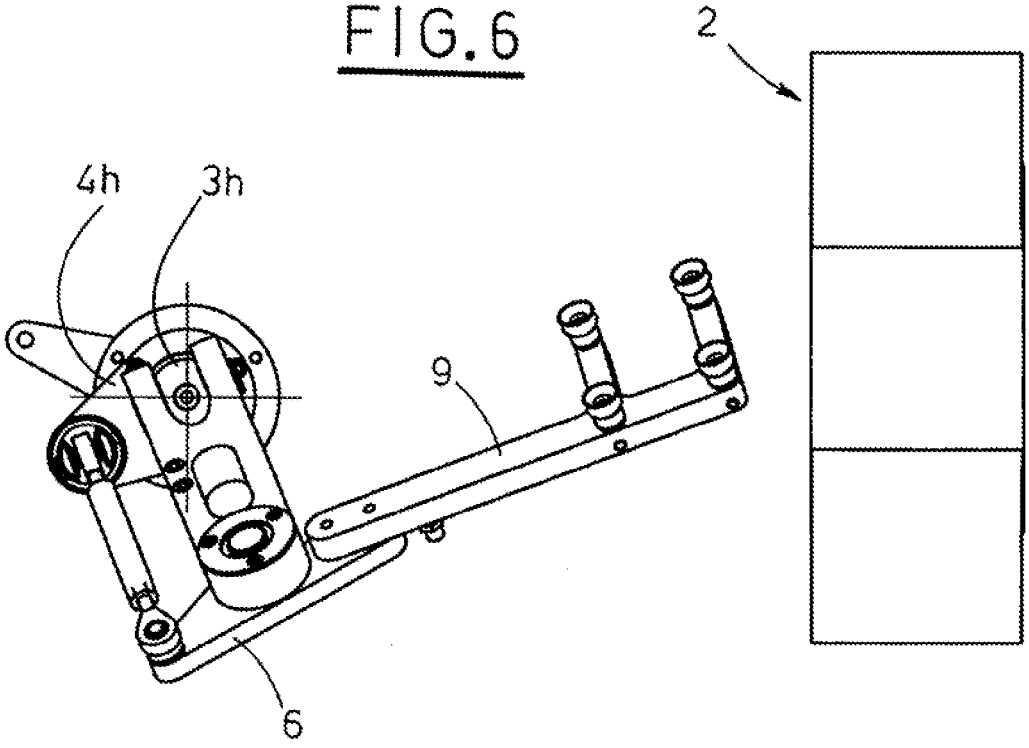
FIG. 6 is a schematic front view of the apparatus proposed by the invention, illustrating the next successive work step which is part of the work cycle, FIG. 6A being a perspective view thereof.

The shaft 3 is operated by first actuating means, not shown, as of conventional type, and situated beside and below the bottom 1*a* of the magazine 1 (FIGS. 1, 2).

The end of the shaft 3 forms, in axial direction, a projection 3*h*, whose functional characteristics will be discussed in the following.

Moreover, the shaft 3 is carried, with possibility to rotate, by a cylindrical jacket 4, which ends with a base 4*h*, through which the projection 3*h* protrudes. (the projection 3*h* is the only part of the transmission shaft 3 seen in the Figures)

A functional arm 5 is hinged on one side to the projection 3*h* of the transmission shaft 3 about a first articulation axis A1, perpendicular to the shaft 3 axis (see Figures for example 2, 5, 5A), so as to receive the rotational motion transmitted by the same shaft 3.

On the other side, the functional arm 5 is hinged to a mechanism 6, 8 for controlling the arrangement, which will be discussed later in the description, about a second articulation axis A2, orthogonal to the first axis A1.

The functional arm 5 is so operated as to oscillate about the first articulation axis A1, by second actuating means, not shown as known, between an alignment position AL and a square position S, and vice versa.

The longitudinal axis of the functional arm 5, in the alignment position, is in alignment with the transmission shaft 3

(FIGS. 1, 1A, 2, 2A), whereas in the square position forms a 90 degrees angle (FIGS. 4, 4A, 4B, 4C) with respect to the rotation axis of the transmission shaft 3.

In the shown example, in particular, the functional arm 5 is operated by the second actuating means through a stem 7, coupled by means of a ball joint to a relative protuberance 5*h* extending from the arm 5.

The above mentioned arrangement control mechanism includes a plate 6 and a tie rod 8 coupled to each other by means of ball joints; the plate 6 is articulated with a relevant central portion to the functional arm 5, about the second articulation axis A2.

The outer parts of the plate 6 are respectively coupled by the above mentioned ball joint to the end of the tie rod 8 and fastened to a pick up arm 9, elements that will be described later.

The other end of the tie rod 8 is coupled by means of a ball joint with a turret 4*k*, which extends from the base 4*h* of the jacket 4 parallel to the axis of the transmission shaft 3; the turret can rotate about a relevant axis (See FIGS. 3 and 4).

The arm 9, as it has already been said, fastened at one side to the plate 6, carries gripping means 11 of known type for gripping a first lateral wall of a flat folded tubular blank 2 through the open bottom 1*a* of the magazine 1.

In the shown example, the gripping means 11 include four suction cups 11*h* connected to a suction source, not shown.

Now, a working cycle of the apparatus proposed by the present invention will be described, with said apparatus working, as specified between the picking up station P and the erection station MV.

FIG. 1 shows the station P and the related picking up of a flat folded tubular blank 2 from the open, inclined bottom 1*a* of the magazine 1, by the pick up arm 9 and after setting the suction cups 11*h* to perform the suction action.

In this step, the functional arm 5 is in the alignment position AL, while the longitudinal axis of the pick up arm 9 forms an angle of about 90 degrees with respect to the functional arm 5.

This square geometrical arrangement of the arms 5, 9 is kept stable due to the presence of the tie rod 8, which allows the group plate 6—pick up arm 9 to remain integral with the functional arm 5 without any possibility to rotate with respect to the second articulation axis A2.

Moreover, during this step in which the lowermost flat folded tubular blank 2 of the pile inside the magazine 1 is picked up, the longitudinal axis of the arm 9 is parallel to the bottom 1*a*, that is to the flat folded profile of the blank 2, in order to allow an optimal gripping of the blank by the suction cups 11*h*; such position in consequent to the consistent rotation of the shaft 3.

When the flat folded tubular blank 2 has been gripped by the suction means 11 (see still FIG. 1), the transmission shaft 3 is rotated in the direction J1 (clockwise according to the view of FIG. 1), by the first actuating means, until the gripped blank 2 assumes a horizontal orientation (FIG. 2).

Then, the first and the second actuating means are operated in mutual time relation, which determines the simultaneous rotation of the transmission shaft 3 in the direction J2 (counterclockwise according to the view of FIG. 3), the downward rotation of the functional arm 5 and the rotation of the plate 6—pick up arm 9 group with respect to the second articulation axis A2 (FIGS. 3, 3A).

This particular movement is caused by the tie rod 8, which can move due to the presence of the ball joints provided at its ends, and by the motion of the turret 4K.

At the end of this step (FIGS. 4, 4A, 4B), the functional arm 5 is in the square position S with respect to the shaft 3, the above mentioned group is substantially aligned with the functional arm and the flat folded tubular blank 2 is in the erection station MV, in which it has a vertical orientation.

The dimensions of the tie rod 8 and its functional interposition between the turret 4*k* and the plate 6 are so designed, obviously bearing in mind other elements of the apparatus 10, as to allow an optimal picking up step of the blank 2 (see above) and the arrangement of the last in the station MV with its axis vertical.

Therefore, the flat folded tubular blank 2, situated in horizontal configuration below the magazine 1 (see FIG. 2 and the relative profile indicated with broken line in FIG. 4C), is moved by the apparatus 10 to the erecting station MV with a combined motion of translation and rotation by an angle of 90° with respect to an axis parallel to the related transversal creasing lines, as it appears from the top view of FIG. 4C, in which the blank 2 is shown in horizontal orientation, with broken line, as well as in the vertical one in the station MV, with continuous line.

Thus, advantageously, the erecting station MV is external with respect to the space occupied by the magazine 1 and anyway, not aligned with it.

This allows the operators to have direct access to the single functional units of the magazine 1, of the apparatus 10 and of the erecting station MV, e.g. during maintenance, jamming or malfunctioning of the boxing machine.

Moreover, it prevents particulate material, produced by the tubular blanks 2 and falling from the magazine 1, from depositing e.g. on the means for erecting each tubular blank 2.

FIGS. 4B, 4C show for example means 12, non belonging to the apparatus 10, situated in the erecting station MV and aimed at erecting the flat folded tubular blank 2.

The means 12 are pivoted with respect to a vertical axis and carry suction cups 12*h* connected to a vacuum source, not shown.

The means 12 are moved on a vertical axis by third actuating means, likewise not shown, between a gripping position, indicated with broken line (FIG. 4B), in which the suction cups 12*h* are operated to grip a second lateral wall of the flat folded tubular blank 2, adjacent to the first lateral wall, likewise subjected to the gripping action of the suction means 11, and an open position, indicated with continuous line (FIGS. 4B, 4C), which causes the rotation of the second lateral wall of the blank 2 by 90° with respect to the first wall, thus erecting the blank 2 and making it assume a parallelepiped shape (FIG. 4C).

The active step of the cycle performed by the apparatus 10 ends when the flat folded tubular blank 2, with its axis oriented vertically, reaches the erecting station MV.

The active step of the cycle is followed by the inactive one, that is the deactivation of the suction cups 11*h* and the repetition of the above described operations, substantially backwards (as shown in FIGS. 5, 5A, 6, 6A), which allow the disengagement of the blank 2 without jeopardizing or slowing down the subsequent processes to which the blank must be subjected (e.g. keeping the blank 2 squared and its vertical filling with articles such as cosmetic products, bottles or similar).

The apparatus 10 proposed by the invention is considerably flexible in relation to the size change requirements: in the magazines 1, in which the flat folded tubular blanks 2 are loaded with the upper connecting end 2*z* always aligned with a fixed plane (e.g. parallel to the same upper wall of the magazine 1), the operator must only carry out the necessary adjustments in the magazine 1 and, possibly, remove the two suction cups 11*h* closest to the pick up arm 9 if, e.g. the new production requires the use of smaller boxes.

This is extremely advantageous because it minimizes the downtimes caused by every size change and thus it increases the productivity of the boxing machine, inside which the apparatus 10 is installed.

Consequently, each tubular blank 2, regardless of its dimensions, reaches the erecting station MV with the outermost connecting end 2*z* always aligned with respect to a fixed vertical axis H1 (FIGS. 4B, 4C), in this particular case coinciding with the articulation axis of the means 12.

This simplifies the adjustments, which must be made to the means 12 due to a size change (that is a simple movement of the related suction cups 12*h*).

Anyway, the definition of a fixed alignment axis H1 is advantageous in general terms, because it can simplify, as in the shown example, the adjustment operations during the blanks size change, performed by the means aimed at the blanks erecting.

Analogous considerations are valid for the magazine 1, where the blanks 2 are loaded also with one of the transversal creasing lines aligned with respect to a fixed reference plane, parallel to the transversal walls of the magazine 1, in particular the creasing line aimed at being situated below, when the blank 2 is in the erecting station MV.

Thus, in this case, the flat folded tubular blanks 2 arrive at the erecting station MV with the lower transversal creasing line always aligned with respect to a fixed horizontal axis H2, regardless of the size change.

It results evident from what above that the apparatus 10 for picking up flat folded tubular blanks 2 from the magazine 1 and for their moving to the erecting station MV includes, as follows and in a cyclical way:

picking up of a flat folded tubular blank 2 through the open, inclined bottom 1*a* of the magazine 1, by gripping its first lateral wall, turned to the magazine outside, and by the downward rotation of the blank 2 until it assumes a horizontal orientation;

moving of the gripped blank 2 toward the erecting station MV, with a combined motion of translation and rotation by 90 degrees with respect to an axis parallel to the transversal creasing lines of the blank 2, so that the latter assumes, in above mentioned erecting station MV, a vertical orientation, with its axis oriented vertically.

As it has been noted during the description, after the above work steps, it is possible to move the second lateral wall of the blank 2, adjacent to the first one, subjected to the gripping action, to define its arrangement at right angle with respect to the first wall, which results in erecting of the blank to assume a parallelepiped shape.

It is specified that the blank 2, after having been gripped and rotated to assume a horizontal orientation, is moved toward the erecting station MV with a combined motion, in which its translation and rotation by a 90° angle with respect to an axis parallel to the related transversal creasing lines are performed at the same time.

Consequently, the present invention proposes by an apparatus for picking up flat folded tubular blanks from the open, inclined bottom of a magazine and for their movement to the erecting station MV, with a vertical orientation and with the related axis arranged vertically.

In this sense, the present apparatus integrates in optimal way with the boxing machines with vertical loading, aimed at vertical introducing of various articles, such as cosmetic products, bottles and similar into the erected boxes.

The magazine proposed in the shown example, has in this specific case, an open inclined bottom, however, other types of magazines are not excluded, such as magazines with vertical and not inclined outlet section, which can be likewise easily integrated with the proposed apparatus.

For this purpose, it is pointed out that, according to the invention, the magazine 1 and the erecting station MV are at comparable levels: this allows the magazine 1 to be arranged in a particularly easy way for the operator to load the flat folded tubular blanks 2.

Another advantage of the invention, though already mentioned, results from the fact that the erecting station MV is clear of the space occupied by the magazine 1 and anyway, not aligned with the latter.

This allows the operators to have direct access to the single functional units of the magazine 1, of the apparatus 10 and of the erecting station MV, e.g. during the maintenance, jamming or a failure of the boxing machine.

Moreover, it prevents particulate material produced by the tubular blanks 2 from falling from the magazine 1 and depositing e.g. on the means for erecting each tubular blank 2.

Therefore, by the light of what above, the proposed invention fully satisfies the prefixed objects: the construction of the apparatus is essential, the apparatus is reliable, ensures high production rate and relatively low costs with respect to the obtained results.

The relative method includes a plurality of fundamental work steps, whose carrying out by the above mentioned apparatus does not interfere with the regular operation of the whole boxing machine.

It is understood that the proposed invention has been described, with reference to the enclosed figures, as a mere, not limiting example. Therefore, it is obvious that any changes or variants applied thereto remain within the protective scope defined by the following claims.

What is claimed is:

1. An apparatus for picking up flat folded tubular blanks from a magazine and for moving the blanks to an erecting station, with two opposite sheets defined in each tubular blank of said tubular blanks and connected to each other at two opposite ends, so as to define a flat folded configuration, said blank having longitudinal creasing lines for facilitating folding, so that a box to be obtained will assumes a substantially parallelepiped shape with a longitudinal axis passing through two opposed openings of a thus obtained box, and transversal creasing lines for facilitating folding of relevant flaps of said blank, and with said magazine having an open bottom for picking up the above mentioned flat folded tubular blanks one by one, with one end of the two connecting ends of said blank turned downwards, the apparatus comprising:

a horizontal shaft for transmission of a rotation movement, the shaft having a rotation axis parallel to opposite, lower and upper edges of said open bottom of said magazine, said shaft being operated by first actuating means and situated beside said open bottom of said magazine;

a functional arm hinged at one side to a projection of said transmission shaft about a first articulation axis, perpendicular to the shaft, so as to receive a motion transmitted by said shaft;

second actuating means for rotating said functional arm about said first articulation axis, in time relation with activation of said first actuating means, between an alignment position, with said functional arm in alignment with said transmission shaft, and a square position, with said functional arm forming a 90 degrees angle with respect to the rotation axis of said transmission shaft, and vice versa;

an arrangement control mechanism hinged to a free side of said functional arm about a second articulation axis orthogonal to said first articulation axis;

a pick up arm, fastened to said arrangement control mechanism and carrying pick up means for picking up a flat folded tubular blank through the open bottom of said magazine;

said arrangement control mechanism being operated in suitable time relation with activation of said first and second actuation means, to operate, said pick up arm between a pick up station for picking up a flat folded tubular blank through the open bottom of said magazine, with said functional arm located in the alignment position and said pick up arm arranged with an arm longitudinal axis parallel to the open bottom of said magazine, and a tubular blank erecting station, with said functional arm located in the square position and the tubular blank arranged with said longitudinal axis vertical, and vice-versa.

2. An apparatus, according to claim 1, wherein said arrangement control mechanism includes:

a plate with a central part hinged to said functional arm at said second articulation axis, said plate being connected at one side to said pick up arm;

a tie rod having one end connected, by means of a ball joint, to one side of said plate opposite to said side of the plate connected to said pick up arm, and one end connected, by means of another ball joint, to a turret, rotating about a rotational axis parallel to the transmission shaft.

3. An apparatus, according to claim 1, wherein the arm longitudinal axis of said functional arm in said square position, is substantially horizontal.

4. An apparatus, according to claim 1, wherein the arm longitudinal axis of said functional arm in said square position, is substantially horizontal and aligned with said pick up arm.

5. An apparatus, according to claim 1, wherein said pick up arm is perpendicular to the arm longitudinal axis of said functional arm during the picking up, in the corresponding station, of a flat folded tubular blank from the open bottom of said magazine.

6. An apparatus, according to claim 5, wherein the open bottom of said magazine is inclined.

7. An apparatus, according to claim 1, wherein said apparatus cooperates functionally, in said erecting station, with means for erecting each tubular blank.

8. An apparatus, according to claim 1, wherein said functional arm is coupled, by means of a ball joint, to a stem, operated by the same second actuating means operating the functional arm.

9. An apparatus, according to claim 1, wherein the open bottom of said magazine is inclined.

10. An apparatus, according to claim 1, wherein said transmission shaft is at a lower level with respect to the open bottom of said magazine.

* * * * *